US006100490A

United States Patent [19]

Türkmen

[11] Patent Number: 6,100,490

[45] Date of Patent: Aug. 8, 2000

[54] CIRCUIT BREAKER FOR LOW TENSION WITH CONNECTING BARS

[75] Inventor: Sezai Türkmen, Berlin, Germany

[73] Assignee: Siemens Aktiengesellschaft, München, Germany

[21] Appl. No.: 09/180,534

[22] PCT Filed: May 7, 1997

[86] PCT No.: PCT/DE97/00976

§ 371 Date: Nov. 10, 1998

§ 102(e) Date: Nov. 10, 1998

[87] PCT Pub. No.: WO97/43775

PCT Pub. Date: Nov. 20, 1997

[30] Foreign Application Priority Data

May 13, 1996 [DE] Germany ..... 196 20 358

[51] Int. Cl.[7] ..... H01H 33/18; H01H 9/44

[52] U.S. Cl. ..... 218/22; 218/36; 335/16; 200/284

[58] Field of Search ..... 335/16, 147, 195; 218/22, 36, 30, 31, 32, 33; 200/284

[56] References Cited

U.S. PATENT DOCUMENTS

| | | | |
|---|---|---|---|
| 3,287,534 | 11/1966 | Cellerini et al. . | |
| 4,277,664 | 7/1981 | Maier et al. . | |
| 4,636,762 | 1/1987 | Marquardt et al. | 335/195 |
| 5,634,552 | 6/1997 | Soberski | 200/284 |

FOREIGN PATENT DOCUMENTS

| | | |
|---|---|---|
| 35 36 112 | 4/1987 | Germany . |
| 43 33 278 | 3/1995 | Germany . |
| 44 16 105 | 5/1995 | Germany . |

*Primary Examiner*—Lincoln Donovan
*Attorney, Agent, or Firm*—Kenyon & Kenyon

[57] ABSTRACT

A low-voltage circuit breaker has an enclosure with a rear wall and a front part, in which there is a switching contact system with connecting bars. Each of the connecting bars has a web arranged transversally to the longitudinal direction of the connecting bars; the webs are used for contacting the mating surfaces of the rear wall of the enclosure. Fastening means act in the longitudinal direction of the connecting bars.

8 Claims, 3 Drawing Sheets

CIRCUIT BREAKER FOR LOW TENSION WITH CONNECTING BARS

FIELD OF THE INVENTION

The present invention relates to a low-voltage circuit breaker with an enclosure having a rear wall and a front part and a switching contact system arranged in the enclosure. The low-voltage circuit breaker has two approximately parallel connecting bars that connect the switching contact system with an external circuit. The connecting bars extend through the window openings in the rear wall and are secured in the enclosure using a fastening means. One of the connecting bars serves as a support of a stationary switching contact and an arcing horn. The other connecting bar is connected through an articulated conductor arrangement to a movable switching contact of the switching contact system.

BACKGROUND INFORMATION

A circuit breaker is described in German Patent No. 44 16 105. In this circuit breaker, screws extending through openings made transversally to the longitudinal axis of the connecting bars are used as the fastening means for the connecting bars, with corresponding female threads provided in the rear wall of the enclosure to accommodate these screws. Since the rear wall of the enclosure is a molded body made of insulating material, usually insert nuts or pressed-in nuts are used for providing the female thread.

In circuit breakers of this type, for high-intensity current that may range between 1000 A and 6000 A, the connecting bars have a considerable cross section. Accordingly, the connecting bars are provided with a plurality of cross bores as needed and a corresponding number of fastener means is required. Therefore, a non-negligible cost for machining the connecting bars is incurred to incorporate connecting bars in such a circuit breaker.

The present invention differs from a circuit breaker described in U.S. Pat. No. 3,287,534, whose main circuit path, in addition to internal main conductors, has external connecting bars detachably connected to the main conductors. These connecting bars have webs extending transversally in their longitudinal direction, which are not used for positioning the main current path as a whole and supporting it in the circuit breaker enclosure. Rather, the webs, designed as rectangular flanges with fastening orifices, provide the user with the option of mounting the connecting bar in two positions 90° apart to match the different possible positions of the downstream connecting bars in a switching system. This arrangement requires separate fastening of the internal main conductor, designed as the support of a stationary switching contact and of an articulated conductor arrangement, in the circuit breaker enclosure. The connecting bars are in turn connected to the main conductors using additional fastening elements. In order to allow the connecting bars to be mounted in a different position, the internal main conductors have a clamping surface, accessible via a window in the rear wall of the circuit breaker enclosure. Thus, in order to make the circuit breaker variably connectable, no effort was made to seek a method of mounting the main current path using the fewest possible fastening elements and the fewest possible machining steps for the components of the main current path.

SUMMARY OF THE INVENTION

An object of the present invention, is to simplify the incorporation of connecting bars.

According to the present invention, this object is achieved by the fact that both connecting bars have a web extending transversally to their longitudinal axis. The rear wall of the enclosure has a mating face as a stop for each of the webs, so that each connecting bar may be introduced in the respective window opening of the rear wall from the side facing the switching contact system until the web contacts the mating surface. The fastening means for keeping the webs in contact with the respective mating surface is designed to act in the longitudinal direction of the connecting bar.

The web provided according to the present invention allows the connecting bars to be supported by the rear wall of the enclosure by their surfaces. The transversal bores in the connecting bars may therefore be omitted. In addition to the associated labor savings, the cross section of the connecting bars is better utilized, since there are no more local cross section reductions due to the transversal bores. Since the forces acting on the connecting bars mainly originate from the switching contact system and therefore act in the direction of the enclosure rear wall, the requirements for the fastening means are less stringent. In particular, the fastening means may be arranged on the side of the rear wall facing the switching contact system and may be mounted in the longitudinal direction of the connecting bars.

The fastening means can also have other functions according to the present invention. For example, an arcing horn belonging to a stationary switching contact may have a support leg flush with the web of the respective connecting bar, the fastening means being arranged so that it traverses the support leg. The fastening means may be designed in the conventional manner as a screw, with a female thread arranged in the rear wall of the enclosure to accommodate the screw.

Furthermore, an arcing contact of a stationary switching contact may also be fastened using the fastening means. The support leg of the arcing horn may be designed as the end part of a bend serving to accommodate the arcing contact in order to facilitate handling these parts.

The above-described arrangement and securing of a connecting bar may also be used, in principle, for a connecting bar provided with a stationary switching contact or with an articulated conductor arrangement. According to a refinement of the present invention, the connecting bar provided with the movable conductor arrangement may be designed so that it requires no special handling. This may be accomplished by providing the connecting bar with an articulated conductor arrangement that has an end face on its side facing the switching contact system. The switching contact system is arranged with a reference dimension with respect to the front part of the enclosure, and a stop surface on the front part of the enclosure, together with the end surface, in a position corresponding to the reference dimension. In this manner, the respective connecting bar is secured requiring no additional measures when the rear wall and the front part of the enclosure are joined together.

If the design of the rear wall does not allow the window opening to be a width sufficient to support the respective connecting bar, according to a refinement of the present invention, a catch enclosing an end part of the connecting bar is provided with an articulated conductor arrangement so that the connecting bar is prevented from pivoting in the respective window opening of the rear wall of the enclosure and may be arranged on the front part of the enclosure.

DETAILED DESCRIPTION

Figure 1:
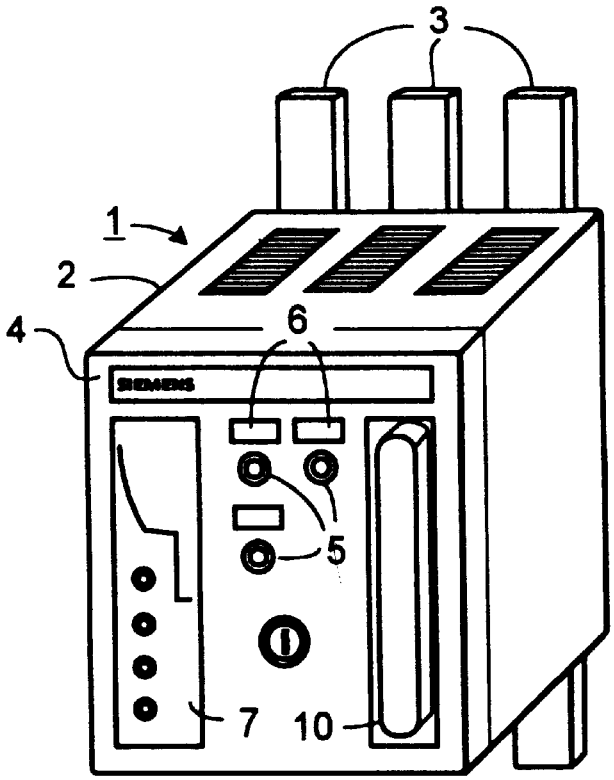
FIG. 1 illustrates a simplified perspective view of a three-pole low-voltage circuit breaker.
Figure 2:
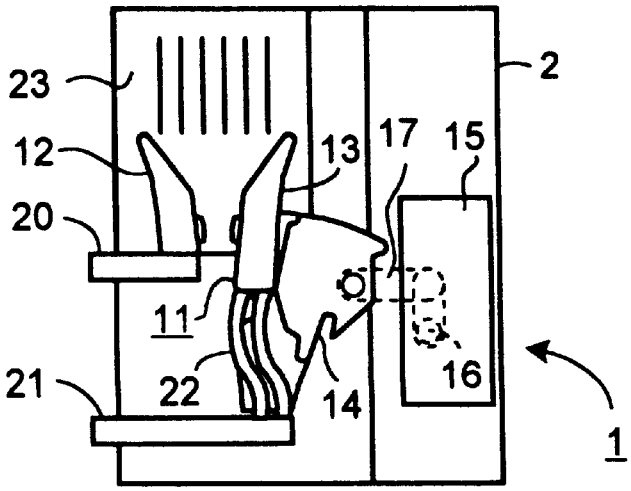
FIG. 2 illustrates a section through the circuit breaker according to FIG. 1, in the area of one pole, showing the basic design of the circuit breaker.

The low-voltage circuit breaker 1 illustrated in FIG. 1 has an enclosure 2 containing three switching contacts arranged next to one another, which correspond to switching systems 11 according to FIG. 2. Further features of circuit breaker 1 shall be explained first with reference to FIG. 1. The above-mentioned switching contact systems 11 are connected to buses 3 via connecting bars 20 and 21 shown in FIG. 2. Pushbuttons 5 for controlling the switching on and switching off operations, as well as display elements 6 for displaying the operating state, are arranged in the center of an operating console 4 of circuit breaker 1. On the left side of operating console 4, there is an electronic tripping device 7 with operator's controls for setting a tripping curve. On the right side of operating console 4 there is an actuating handle 10 for manually tensioning an energy storage device.

Switching contact system 11 is now explained in detail with reference to FIG. 2. A stationary switching contact 12 and a movable switching contact 13 are parts of the switching contact system 11. A movable contact holder 14 may accommodate one or more movable switching contacts 13. A drive device 15 has a switching shaft 16, which is connected to contact holder 14 via a coupling rod 17. Switching shaft 16 is common to all switching contact systems 11 of circuit breaker 1.

Stationary switching contact 12 is connected to a connecting bar 20. Lower connecting bar 21 runs parallel to connecting bar 20, which is connected to movable switching contact 13 through a movable conductor arrangement 22. Movable conductor arrangements are understood in the present case as being all suitable devices such as foil packs, flexible strands, and current-conducting joints. An arc extinguishing chamber 23, provided to support arc extinguishing in a conventional manner, is above switching contact system 11.

Figure 3:
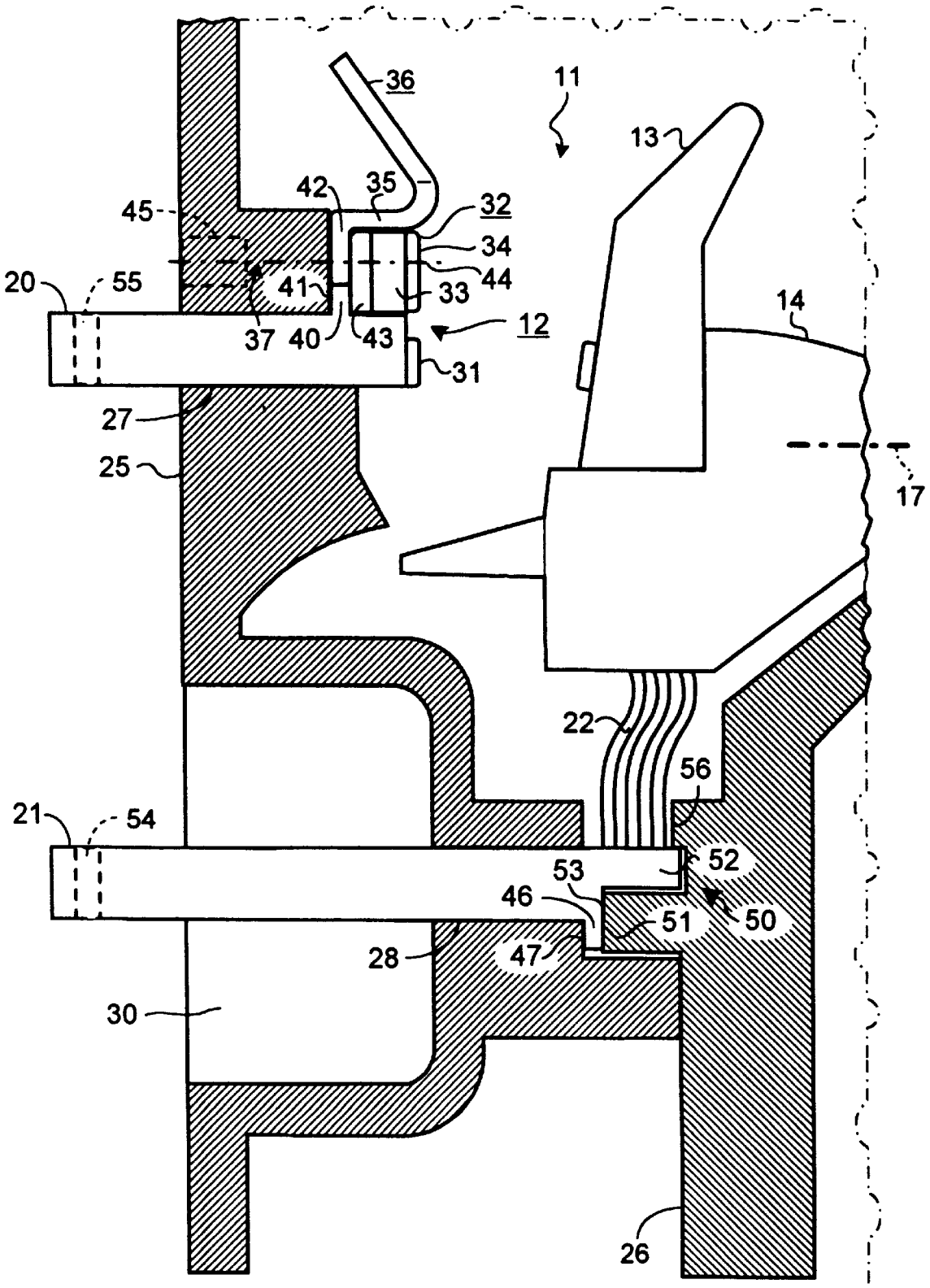
FIG. 3 illustrates an enlarged representation of FIG. 2, in particular the details of the securing of the connecting bars of the circuit breaker.

A rear wall 25 and a front part 26 are shown in FIG. 3 as components of enclosure 2 (FIGS. 1 and 2) partly in section. Drive device 15 shown in FIG. 2 is located to the right of front part 26 in FIG. 3. Rear wall 25 is provided with an upper window opening 27 and a lower window opening 28 to accommodate connecting bars 20 and 21. Lower window opening 28 is on the bottom of a chamber 30, which is formed by a depression in rear wall 25 and serves, in a conventional manner, to accommodate a current transformer (not indicated), which surrounds, approximately concentrically, lower connecting bar 21.

Upper connecting bar 20 is provided with the above-mentioned stationary switching contact 11, which is a component having several parts. In particular, this component includes a strip-shaped contact seat, mounted on the end face of connecting bar 20, serving as a main contact 31 (see also FIG. 4). Furthermore, an arcing contact 32, including an arcing contact holder 33 and a contact seat 34, is located above main contact 31. Arcing contact 32 is accommodated between the top of connecting bar 20 and a bend 35 of an arcing horn 36, which is used, in a known manner, for transferring a switching arc into arc extinguishing chamber 23 (FIG. 2).

The above-described components, namely connecting bar 20 with main contact 31, arcing contact 32 and arcing horn 36, are connected and attached to rear wall 25 via a common fastening means 37. Fastening means 37 is a combination of components working together, for whose operation a web 40 running on the top of connecting bar 20 transversally to its longitudinal axis, is essential. A mating surface 41 on the inside of rear wall 25 is used as a stop for web 40. A support web 42, formed by one end part of bend 35 of arcing horn 36, has the same thickness as web 40 and is in contact with the latter, so that both parts are aligned with one another. A pressure piece 43, provided with through orifices or recesses on its edges for two screws 44 represented in FIG. 3 by their cental axes, is located between bend 35 of arcing horn 36 and the top of connecting bar 20. The heads of screws 44 can be seen in FIG. 4. Nuts or threaded pieces inserted in pockets of rear wall 25 are used as female threads 45 for screws 44. The arcing contact 32, which is also provided with through orifices or edge recesses for screws, is in contact with pressure piece 43. Pressure piece 43 and arcing contact holder 33 may also be designed in one piece.

Figure 4:
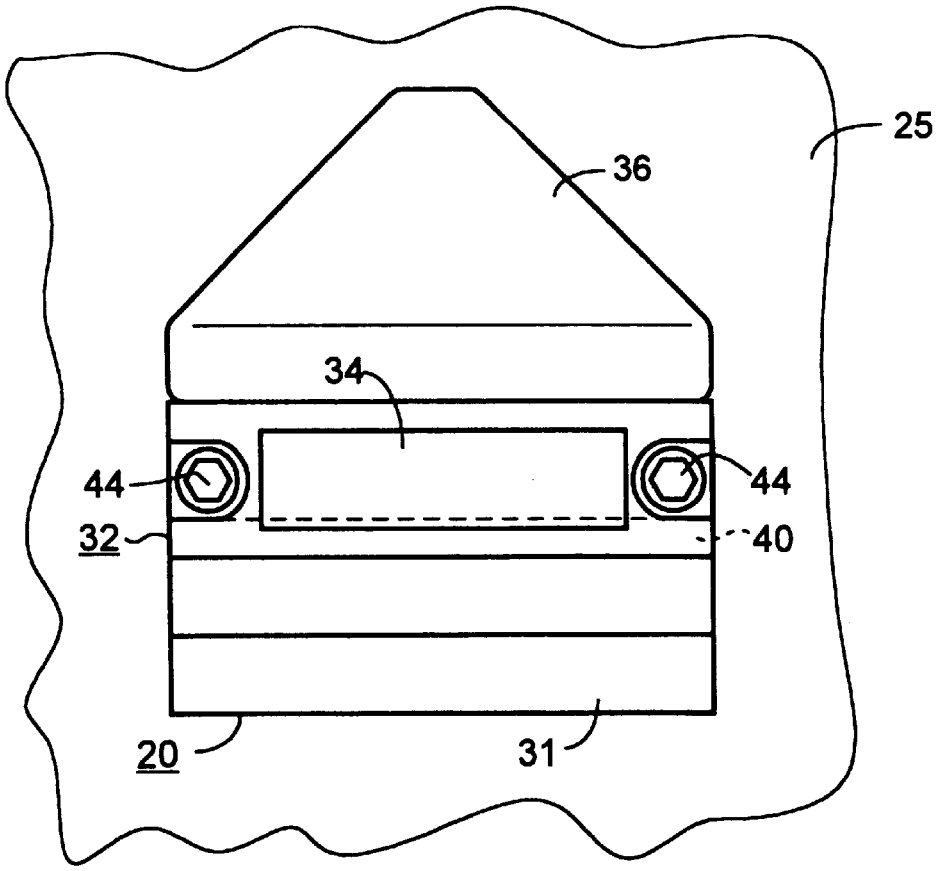
FIG. 4 illustrates a view of a connecting bar provided with a stationary switching contact.

While fastening means 37 include two screws 44 in the embodiment illustrated in FIGS. 3 and 4, obviously a single screw 44 may be sufficient if connecting bar 20 is narrower, while three or more screws may be appropriate for a larger width, corresponding to a higher current intensity.

In order to assemble the above-mentioned parts, connecting bar 20 is initially inserted in window opening 27 in rear wall 25 until web 40 contacts mating surface 41. Then arcing horn 36 with its holding web 42 and arcing contact 32, as well as optionally pressure piece 43, are also positioned on mating surface 41, whereby the parts are aligned and their through orifices or recesses are flush with screw holes for screws 44. Then screws 44 are inserted and tightened. Thereby the connecting bar, arcing horn 36, and arcing contact 32 are firmly connected to rear wall 25, although connecting bar 20 does not have the usual transversal holes. This does not impair good current conductance from connecting bar 20 to arcing contact 32 and arcing horn 36, since these parts are in surface contact with web 40. Pressure piece 43 (or, in the case of single-piece design, arcing contact holder 33) acts here as a bridge contact between web 40 and arcing horn 36.

Lower connecting bar 21 is connected to the rear wall by the same principle described above, as illustrated in the bottom part of FIG. 3. For this purpose, connecting bar 21 extends through window opening 28 and is in contact with a mating surface 47 of rear wall 25 through a web 46. Respective fastening means 50, like fastening means 37, represents a combination of parts and design features. In particular, front part 26 of enclosure 2 (FIGS. 1 and 2) is provided with a stop surface 51 for this purpose. An enlarged end surface 53, flush with web 46, is formed on connecting bar 21 through an end part 52 having an enlarged cross-section; stop surface 51 is in contact with end surface 53. Movable conductor arrangement 22 (FIG. 2), designed as a flexible strand, which establishes the electrical connection between connecting bar 21 and movable switch contact 13, is connected to end part 52.

Connecting bar 21 is assembled according to the previous description for connecting bar 20, i.e., connecting bar 21 is inserted in window opening 28 until web 46 contacts mating surface 47 of rear wall 25. The components are permanently secured by joining rear wall 25 and front part 26 together, forming enclosure 2; it is ensured, through appropriate selection of the reference dimensions, that rear wall 25 and front part, as well as connecting bar 21, assume a correct position.

Due to its function of establishing connection to movable switch contact 13, connecting bar 21 is longer than upper connecting bar 20. Its support, formed by window opening 28, is at a certain distance from clamping point 54, while a corresponding clamping point 55 of upper connecting bar 20 is positioned close to the window opening. Thus the two connecting bars 20 and 21 can respond to forces arising at clamping points 54 and 55 in different manners. In order to prevent this from happening, front part 26 of enclosure 2 has a projection 56, so that end part 52 of connecting bar 21 is also surrounded and supported in an area that is approximately diagonally opposite web 46. This prevents connecting bar 21 from vibrating within window opening 28.

Figure 5:
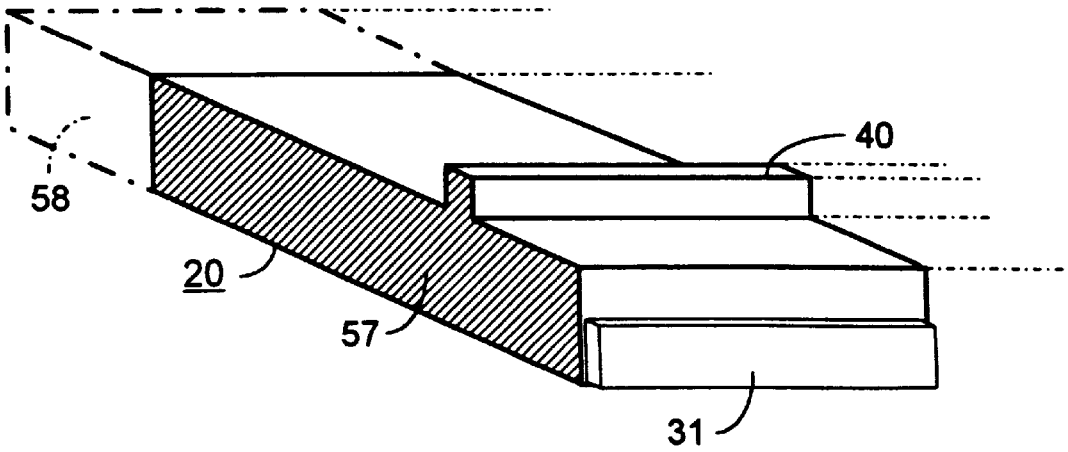
FIG. 5 illustrates a perspective view of a section of a semifinished part used for manufacturing connecting bars.

In order to manufacture connecting bars 20 and 21, a semifinished part with an appropriate profile can be used, from which the necessary sections can be cut and provided with the necessary design features (bore holes, recesses, bevels, etc.) by machining. For this purpose, a profiled semifinished product already having web 40 or 46 (FIG. 3) is especially appropriate, so that the blanks needed for connecting bars 20 and 21 are formed by subdividing the semifinished pieces across their longitudinal direction. This is indicated in FIG. 5 by a side surface 57 shown as a shaded area. Furthermore, an area 58 shown in dashed lines indicates that a semifinished part has a suitable dimension for manufacturing the longer connecting bar 21 and therefore a piece must be cut off it to manufacture the shorter connecting bar 20. This piece can be further processed without waste, for example, by manufacturing minor contact parts from it.

What is claimed is:

1. A low-voltage circuit breaker, comprising:

an enclosure including a rear wall and a front part, the rear wall having window openings and mating surfaces; and a switching contact system arranged in the enclosure, the switching contact system including:

two connecting bars for connecting the switching contact system to an external circuit, the two connecting bars being approximately parallel to one another, each respective one of the two connecting bars being fastened to the enclosure via a respective fastener, the respective one of the two connecting bars having a respective web, the respective web extending transversally in a longitudinal direction of the respective one of the two connecting bars, a respective one of the mating surfaces of the rear wall being a stop for the respective web so that the respective one of the two connecting bars can be inserted from a side of the rear wall facing the switching contact system into a respective one of the window openings until the respective web contacts the respective one of the mating surfaces, the respective fastener of the respective one of the two connecting bars maintaining the respective web in contact with the respective one of the mating surfaces, the respective fastener acting in the longitudinal direction of the respective one of the two connecting bars, a stationary switching contact being supported by a first one of the two connecting bars, an arcing horn being supported by the first one of the two connecting bars, and a movable switching contact being coupled to a second one of the two connecting bars via an articulated conductor arrangement.

2. The low-voltage circuit breaker according to claim 1, wherein each respective fastener is arranged on the side of the rear wall facing the switch contact system and being mounted in the longitudinal direction of the respective one of the two connecting bars.

3. The low-voltage circuit breaker according to claim 2, wherein the arcing horn includes a support leg flush with the respective web of the first one of the connecting bars, the respective fastener of the first one of the two connecting bars being arranged to traverse the respective web of the first one of the two connecting bars and the support leg.

4. The low-voltage circuit breaker according to claim 3, wherein at least one of the respective fasteners includes a screw, a female thread being arranged in the rear wall of the housing to accommodate the screw.

5. The low-voltage circuit breaker according to claim 3, wherein the respective fastener of the first one of the two connecting bars fastens an arcing contact.

6. The low-voltage circuit breaker according to claim 5, wherein the support leg is an end part of a bend accommodating an arcing contact.

7. The low-voltage circuit breaker according to claim 1, wherein the second one of the two connecting bars has an end surface on a side of the second one of the two connecting bars facing the switching contact system, the end surface being arranged with a reference dimension in relation to the front part of the enclosure, the respective one of the mating surfaces of the second one of the two connecting bars arranged on the front part of the enclosure in a position corresponding to the reference dimension.

8. The low-voltage circuit breaker according to claim 7, wherein a catch is arranged on the front part of the enclosure, the catch enclosing a first end part of the second one of the two connecting bars and supporting the second one of the two connecting bars against a rotating motion in the respective one of the window openings.

* * * * *